US008292582B1

(12) United States Patent
Liang

(10) Patent No.: US 8,292,582 B1
(45) Date of Patent: Oct. 23, 2012

(54) TURBINE BLADE WITH SERPENTINE FLOW COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 763 days.

(21) Appl. No.: 12/500,346

(22) Filed: Jul. 9, 2009

(51) Int. Cl.
*F01D 5/18* (2006.01)

(52) U.S. Cl. ..... 416/97 R; 416/1

(58) Field of Classification Search ..... 416/95, 416/96, 97 R, 1; 415/115
See application file for complete search history.

(56) References Cited

U.S. PATENT DOCUMENTS 3,191,908 A * 6/1965 Petrie et al. ..... 416/96 R
4,180,373 A * 12/1979 Moore et al. ..... 416/97 R
5,813,835 A * 9/1998 Corsmeier et al. ..... 416/97 R
2003/0026698 A1* 2/2003 Flodman et al. ..... 416/97 R
2008/0050242 A1* 2/2008 Liang ..... 416/97 R
2009/0097977 A1* 4/2009 Cunha ..... 416/95

* cited by examiner

*Primary Examiner* — Ninh H Nguyen
*Assistant Examiner* — Joshua R Beebe
(74) *Attorney, Agent, or Firm* — John Ryznic

(57) ABSTRACT

A turbine blade with a low flow cooling circuit that includes two 5-pass serpentine flow circuits that are partially separated and partial combined to form the low flow capability while providing adequate cooling for the blade. The pressure sidewall and the suction sidewall both include an up-pass channel and a down-pass channel to form the first two legs of two serpentine flow circuits. Positioned between the up-pass and down-pass channels are two mid-chord channels that form third and fourth legs of the common serpentine flow circuit. A fifth leg is formed through a trailing edge up-pass channel that provides cooling air for a trailing edge cooling circuit with exit holes. The forward most mid-chord chamber that forms the third leg supplies impingement cooling air to the leading edge cooling circuit that also includes film cooling holes for the leading edge surface.

12 Claims, 8 Drawing Sheets

View A-A

View A-A

View B-B

TURBINE BLADE WITH SERPENTINE FLOW COOLING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to an air-cooled turbine rotor blade with a thick TBC and a low cooling flow.

2. Description of the Related Art Including Information Disclosed Under 37 CFR 1.97 and 1.98

In a gas turbine engine, a high temperature gas flow is passed through the turbine to produce mechanical work to drive the compressor and, in an industrial gas turbine engine, to also drive an electric generator and produce electrical energy. Passing a higher temperature gas flow into the turbine can increase the efficiency of the engine. However, the turbine inlet temperature is limited by the material properties of the first stage stator vanes and rotor blades as well as the amount of cooling that can be produced by passing cooling air through these airfoils (vanes and blades). If the turbine inlet temperature is too high, then the first stage vanes and blades can become too hot and even melt. Thus, one method of increasing the turbine inlet temperature is to form the turbine vanes and blades from even higher temperature resistant materials.

Another method of allowing for an increase in the turbine inlet temperature is to provide cooling for the airfoils. Airfoil designers try to minimize the amount of cooling air used in the airfoils since the cooling air is typically bled off from the compressor and thus is not used to produce work and the energy used to compress the air is thus wasted. Complex airfoil internal cooling circuits have been proposed that include combinations of convection cooling, impingement cooling and even film cooling of the airfoil outer surfaces.

FIG. 1 shows a typical first stage turbine blade external pressure profile. As seen in FIG. 1, the forward region of the pressure side surface experiences a higher hot gas static pressure while the entire suction side external surface of the airfoil is at a much lower hot gas static pressure than the pressure side. The vertical dashed line in FIG. 1 represents the highest pressure on the external surface of the airfoil just downstream from the leading edge region. One can see that the pressure on the suction side opposite from the highest pressure on the pressure side is much lower.

FIGS. 2 through 4 shows a prior art cooling circuit for a first stage turbine blade in an industrial gas turbine (IGT) engine. This cooling circuit is referred to as a 1+5+1 forward flowing serpentine cooling circuit and includes a leading edge cooling air supply channel 11 located in the leading edge region of the airfoil to supply cooling air to a leading edge impingement cavity 12 through a row of metering and impingement holes 13, and with a showerhead arrangement of film cooling holes 14 and gill holes 15 on both sides of the leading edge region to provide film cooling on the leading edge region.

The airfoil mid-chord region is cooled by a 5-pass forward flowing serpentine flow circuit that includes a first leg or channel 21 adjacent to a trailing edge region, followed by the second leg 22, third leg 23, fourth leg 24 and fifth leg 25 to form the serpentine flow path. As seen in FIG. 2, film cooling holes 35 are used on the pressure side and suction side walls to discharge cooling air from some of the legs 21-25 that form the serpentine flow circuit.

Also seen in FIGS. 2 and 4 is the trailing edge region cooling circuit that includes a trailing edge cooling air supply channel 31 that feeds into a row of metering and impingement holes 32 and impingement cavities 33 that form a series of metering and impingement holes followed by impingement cavities to provide cooling for the trailing edge region. A row of cooling air exit holes is arranged along the trailing edge to discharge the cooling air. A row of film cooling holes 35 is connected to the first impingement cavity 33 to discharge film cooling air onto the pressure sidewall.

For a forward flowing 5-pass serpentine cooling design of FIGS. 2-4 used in the airfoil mid-chord region, the cooling air flows toward the leading edge and discharges into the high hot gas side pressure section of the pressure side. In order to satisfy the back flow margin (the hot gas flow does not flow into the internal cooling passages of the airfoil), a high cooling air supply pressure is needed for the FIG. 2 design, and therefore will induce a high leakage flow. In the FIG. 2 airfoil cooling circuit, the blade tip section is cooled with two tip turns in conjunction with local film cooling. Cooling air bleed off from the 5-pass serpentine flow circuit will reduce the cooling performance for the serpentine flow circuit. Independent cooling flow circuits from the mid-chord cooling circuit is used to provide cooling for the airfoil leading and trailing edges.

As the TBC technology improves and more IGT engine turbine blades are applied with relatively thick or low conductivity TBC, the amount of cooling air required is reduced. As a result, there is not sufficient cooling airflow for the prior art 1+5+1 cooling circuit of FIGS. 2-4. Cooling air flow for the blade leading edge trailing edges has to be combined with the mid-chord cooling circuit to form a single 5-pass flow circuit in order to provide adequate cooling for the entire airfoil using the low flow cooling air used for low cooling flow airfoils. However, for a single forward flowing 5-pass serpentine cooling circuit with total blade cooling flow, the BFM (back flow margin) may become a serious design issue.

In order to avoid the BFM issue described above in the FIG. 2 cooling circuit, the forward flowing 5-pass serpentine circuit of FIG. 2 can be transformed into an aft flowing 5-pass serpentine circuit as seen in the FIGS. 5 and 6 design. The FIGS. 5 and 6 design transforms the airfoil cooling with a single 5-pass aft flowing serpentine cooling circuit that includes a forward section leading edge impingement cavity 46 and an aft flowing serpentine flow circuit with a first leg 41 located adjacent to the impingement cavity 46, a second leg 42, a third leg 43, a fourth leg 44 and a fifth leg 45 that forms the 5-pass serpentine aft flowing circuit. A row of metering and impingement holes 47 connects the first leg 41 to the impingement cavity 46, and a showerhead arrangement of film cooling holes 48 connects the impingement cavity 46 to discharge the layer of film cooling air onto the leading edge of the airfoil. The fifth leg 45 is connected to a row of trailing edge exit holes 49 to discharge the spent serpentine flow cooling air through the trailing edge of the airfoil.

For the forward section of the blade leading edge impingement cooling in the FIG. 5 designs, it is normally designed in conjunction with leading edge backside impingement cooling plus a showerhead arrangement of film cooling holes with pressure side and suction side film discharge cooling holes (not shown in FIG. 5 or 6). Cooling air is supplied from the first up-pass channel 41 of the 5-pass serpentine circuit. The impingement cooling air is normally fed through a row of metering holes 47, and impinged onto the backside of the airfoil leading edge surface to provide backside impingement cooling of the leading edge prior to discharging the spent impingement cooling air as film cooling air through the showerhead holes and the P/S and S/S gill holes. One possible drawback for the 5-pass aft flowing serpentine cooling circuit of FIGS. 5 and 6 is the heat pick up by the cooling flow. As the cooling air reaches the airfoil trailing edge, the heated cooling air looses its cooling potential since the cooling air is being heated as it travels through the 5 legs of the serpentine circuit. Thus, with the cooling circuit of FIGS. 5 and 6, a turbine upgrade may become a design limitation.

BRIEF SUMMARY OF THE INVENTION

It is an object of the present invention to provide for a turbine rotor blade with a cooling circuit that can be used on a blade with a relatively thick TBC and a relatively low cooling airflow.

It is another object of the present invention to provide for a turbine rotor blade which overcomes the back flow margin (BFM) issued that occur in the prior art single pass forward flowing 5-pass serpentine circuit in the 1+5+1 blade cooling circuit of the prior art.

It is another object of the present invention to provide for a turbine rotor blade cooling circuit that overcomes the blade design limitation of the prior art aft flowing 5-pass serpentine cooling circuit in which the cooling air becomes too hot to provide adequate cooling for the trailing edge end of the blade.

These objectives and more are achieved in the turbine blade cooling circuit of the present invention which includes a 5-pass serpentine flow circuit with a forward flowing near wall cooling at the airfoil mid-chord section and a 3-pass aft flowing serpentine circuit connected to an end of the forward flowing circuit to form a dual pass near wall serpentine flow cooling channel. Cooling air is supplied top channels on the pressure side and the suction side walls at a mid-chord region to flow up toward the blade tip, then turns at a tip turn channel and flows downward in channels on the pressure side and the suction side walls where the two paths merge into a common third leg that flows up toward the blade tip in-between the two down-pass channels of the second legs. The cooling air then flows around a tip turn in-between the tip turns between the first and second legs, and then flows down in a common fourth leg channel in-between the first legs on the pressure side and suction side walls. The cooling air then flows into a fifth common leg located adjacent to the trailing edge region where the cooling air is gradually bled off through multiple trailing edge metering and impingement holes and impingement cavities to cool the trailing edge region, and then discharged through a row of trailing edge cooling exit holes. A leading edge impingement cavity with showerhead film cooling holes and gill holes is connected to the common third leg channel that forms a mid-chord chamber between the pressure side and suction side channels that form the second leg of the serpentine flow circuit.

DETAILED DESCRIPTION OF THE INVENTION

Figure 1:
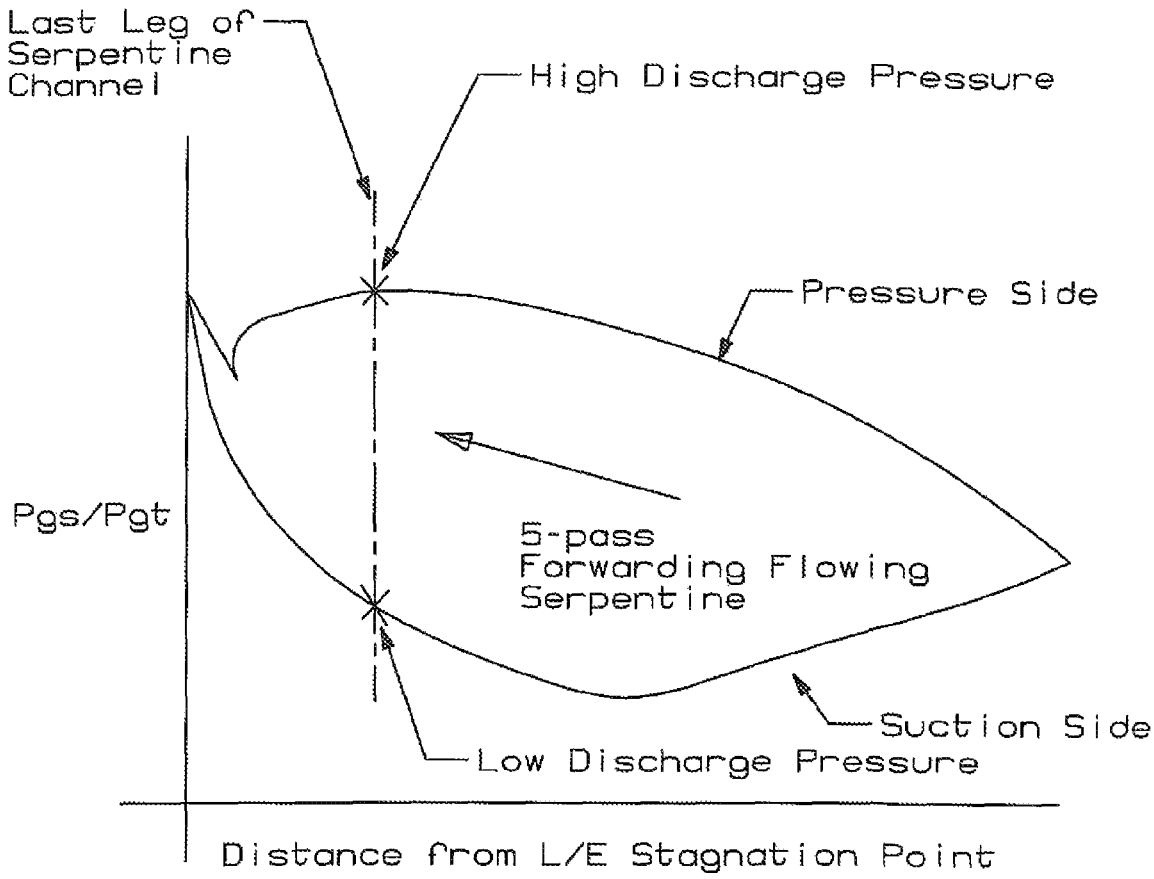
Fig 1 Prior Art
FIG. 1 shows a graph of the external pressure profile of a prior art first stage turbine rotor blade.
Figure 2:
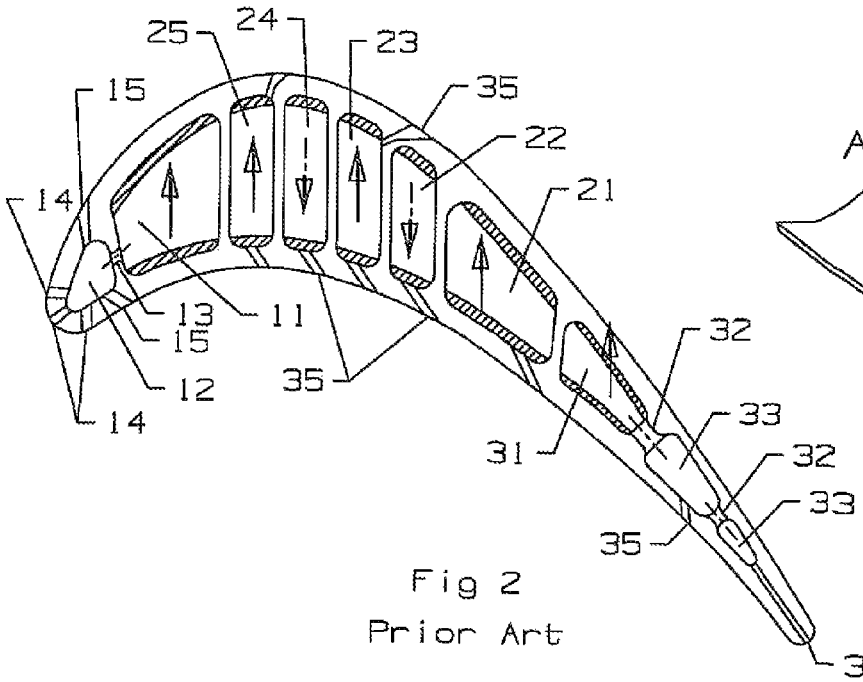
Fig 2 Prior Art
FIG. 2 shows a cross section view along a radial direction of a prior art blade cooling circuit of the 1+5+1 forward flowing serpentine cooling circuit.
Figure 3:
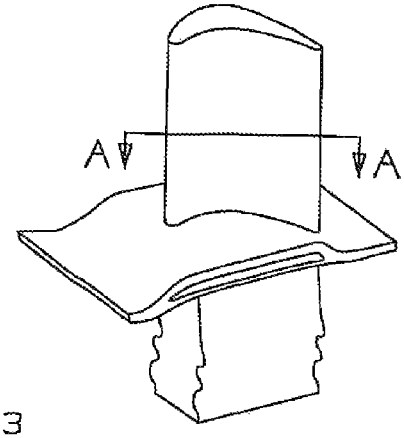
Fig 3 Prior Art
FIG. 3 shows an isometric view of the prior art first stage turbine blade of FIG. 2.
Figure 4:
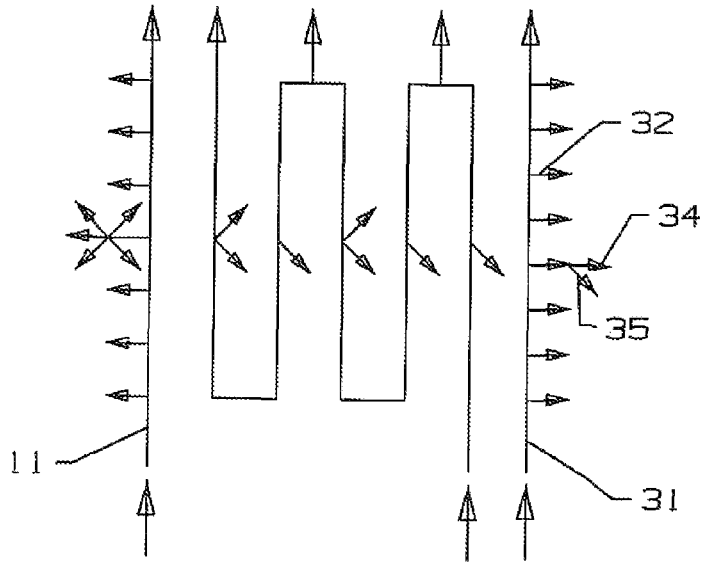
Fig 4 Prior Art
FIG. 4 shows a flow diagram of the 1+5+1 forward flowing serpentine circuit of FIG. 2.
Figure 5:
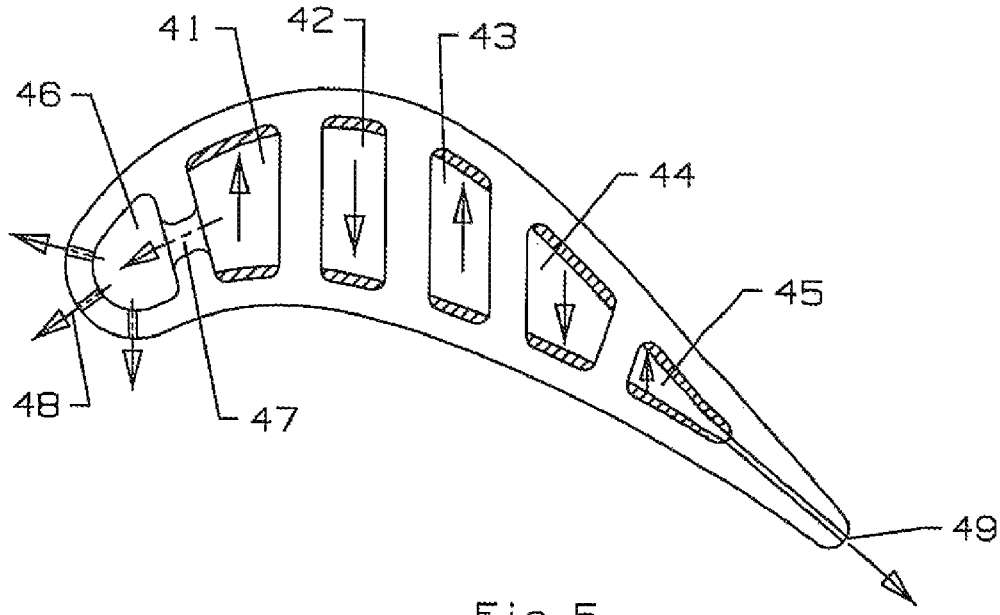
Fig 5 Prior Art
FIG. 5 shows a cross section view along a radial direction of another prior art first stage blade cooling circuit of the 5-pass aft flowing serpentine cooling circuit.
Figure 6:
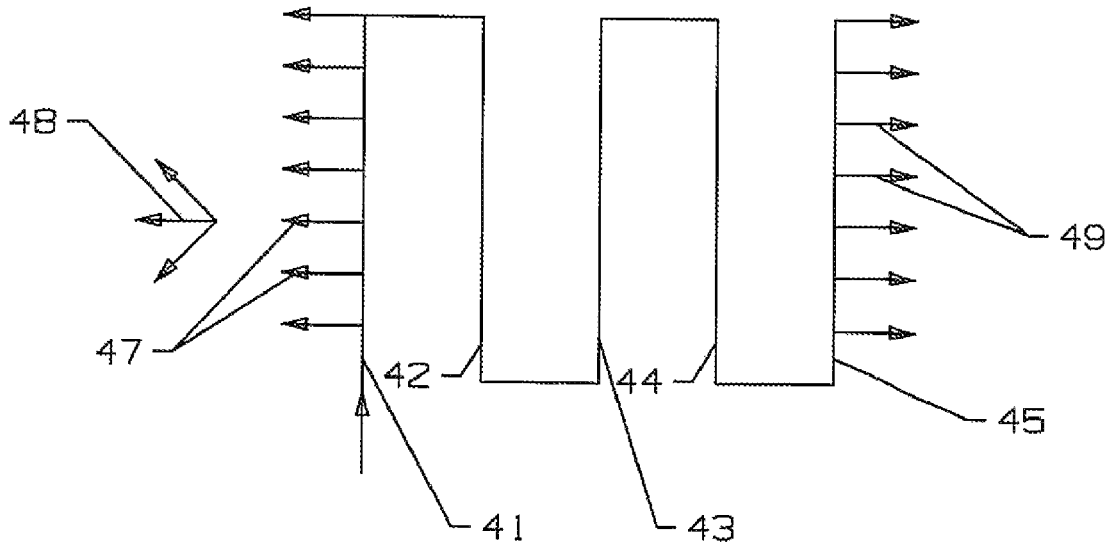
Fig 6 Prior Art
FIG. 6 shows a flow diagram of the aft flowing serpentine circuit of FIG. 5.
Figure 7:
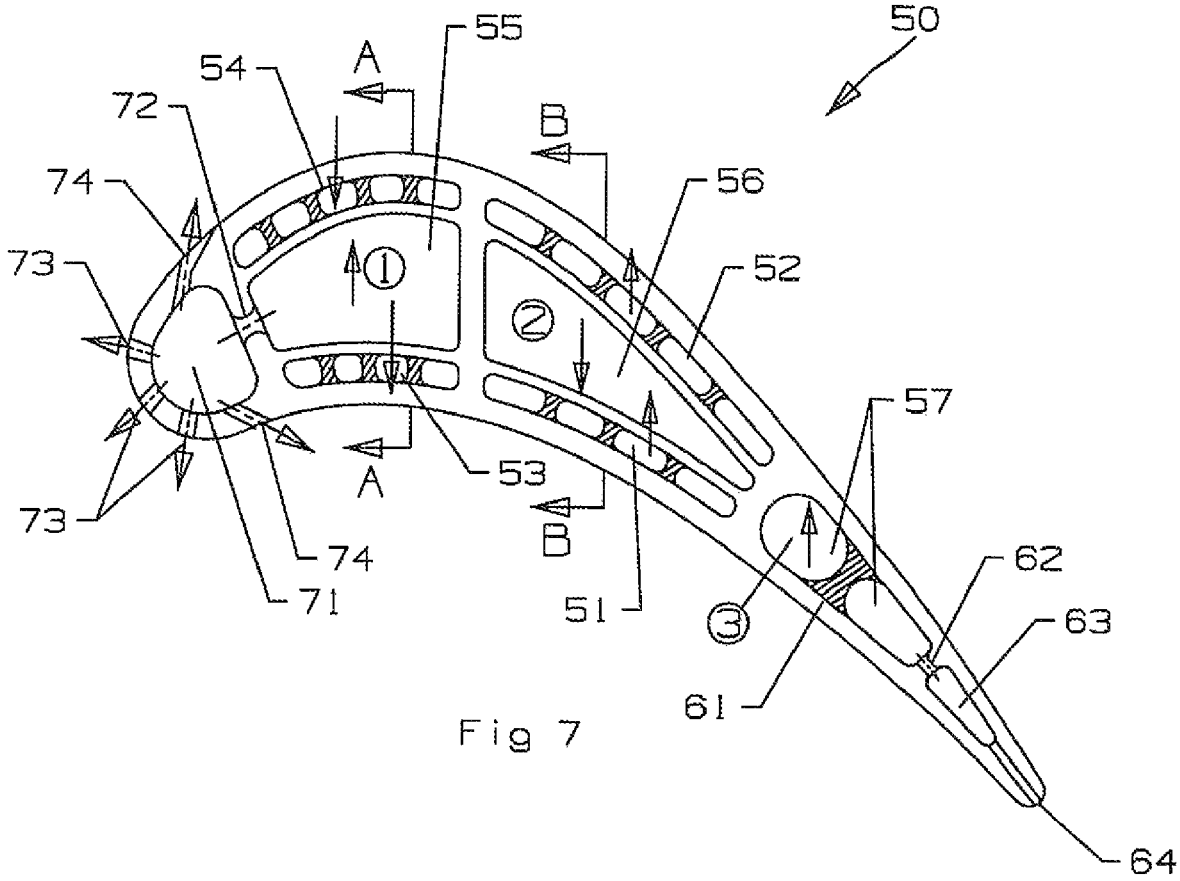
FIG. 7 shows a cross section view along the radial direction of the serpentine flow cooling circuit of the present invention.

The present invention is a new cooling circuit for an airfoil of a turbine rotor blade, preferably for an IGT engine rotor blade, that can be used with a relatively (in terms of the prior art) thick TBC and with relatively low cooling flow which will be needed in the new engines that are being designed. FIG. 7 shows a cross section view through a slice of the blade along a radial direction of the airfoil in which the leading edge and trailing edge with the pressure sidewall and the suction sidewall clearly defined. Pressurized cooling air from an external source to the blade is supplied to a common supply cavity 65 formed within the blade root (see FIG. 9) and then splits up to flow into a first up pass 51 along the pressure side wall and a first up pass 52 along the suction side wall. Each pass or passage 51 and 52 includes pin fins extending across to add rigidity to the airfoil walls and to promote heat transfer from the hot metal surfaces to the cooling airflow.

Located forward of the two first up pass channels 51 and 52 are two down pass channels 53 and 54 with one down pass channel 53 located along the pressure side wall and the other 54 located along the suction side wall. Again, each of these channels includes pin fins extending across the channel. The two up pass channels 51 and 52 are connected to the two down pass channels 53 and 54 through a separate tip turn channel 58 that also provides cooling to the blade tip section of the tip turn channel 58.

A first mid-chord chamber 55 is formed between the down pass channels 53 and 54, and a second mid-chord chamber 56 is formed between the two up pass channels 51 and 52. A leading edge impingement cavity 71 is located I the leading edge region and is connected to the first mid-chord chamber 55 through a row of metering and impingement holes 72. A showerhead arrangement of film cooling holes 73 is connected to the leading edge impingement cavity 71 as well as pressure side and suction side gill holes 74.

Figure 10:
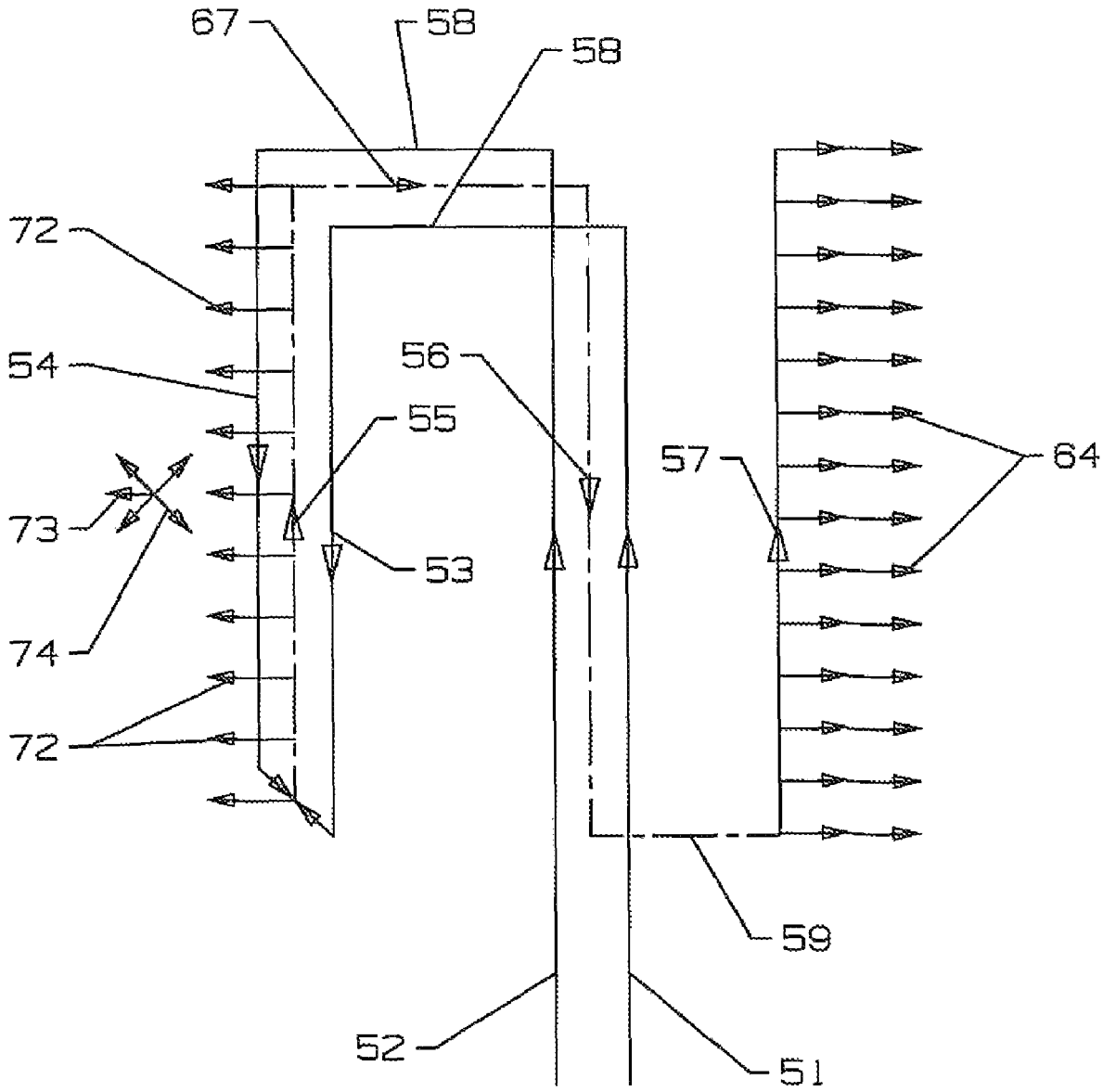
FIG. 10 shows a flow diagram of the cooling circuit of the present invention in FIGS. 7 through 9.
Figure 11:
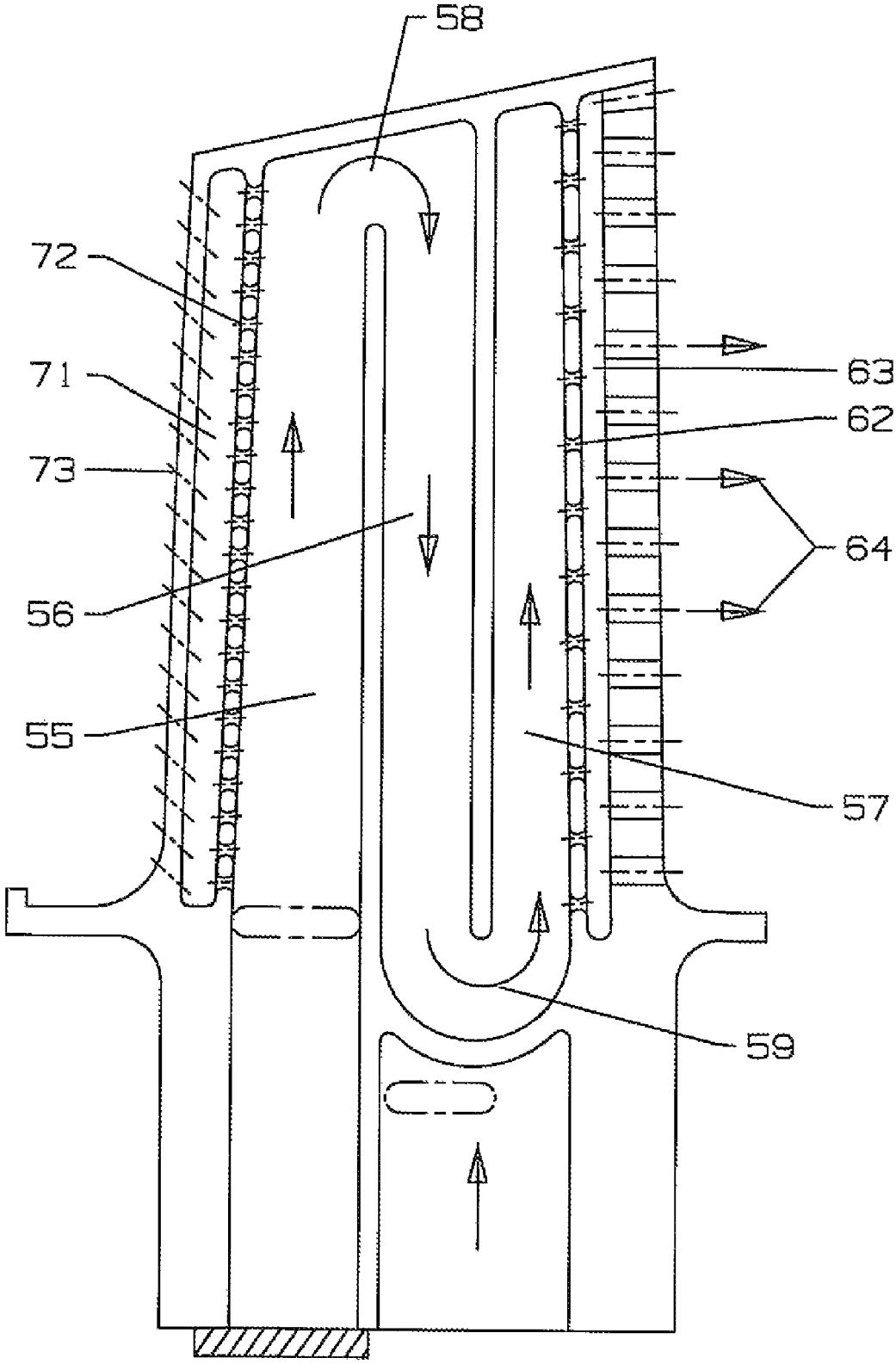
FIG. 11 shows a cross section view through a mid-chord line of the cooling circuit of the present invention of FIGS. 7 through 10.

In the trailing edge region of the airfoil is a trailing edge up pass channel 57 with pin fins extending across the channel, where the channel 57 is connected to the second mid-chord chamber 56 through a root turn channel 68 as seen in FIGS. 10 and 11. A row of metering and impingement holes 62 and impingement cavities 63 is connected to the trailing edge up pass channel 57 to provide cooling for the trailing edge region of the airfoil. A row of trailing edge exit holes or slots 64 is connected to the impingement cavities 63 to discharge the spent cooling air from the airfoil and cool the trailing edge.

Figure 8:
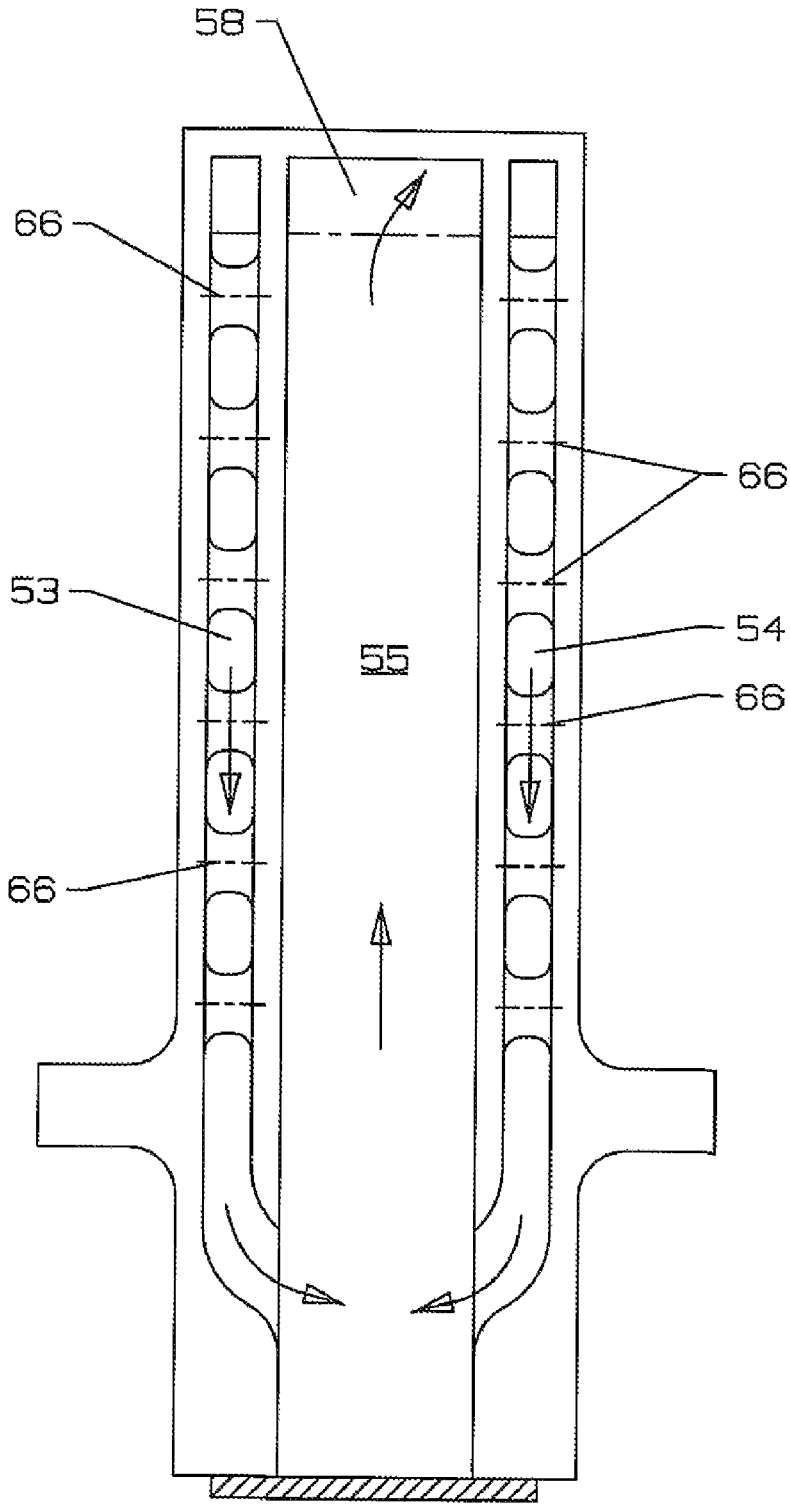
FIG. 8 shows a cut-away view of the blade cooling circuit through a line A-A in FIG. 7.

FIG. 8 shows a cross section of the blade through a line A-A shown in FIG. 7 with the pressure sidewall on the left of this figure. The first mid-chord chamber 55 is shown in-between the two up-pass channels 53 and 54 formed on the pressure side and the suction side walls. The pin fins 66 are shown extending across the two channels to promote heat transfer from the hot metal surfaces to the cooling air. The tip turn 58 between the first mid-chord chamber 55 and the second mid-chord chamber 56 is seen at the top of FIG. 8. The cooling air that flows down through the two down-pass channels 53 and 54 is collected in the first mid-chord chamber 55, which then flows up through the tip turn channel 58 and into the second mid-chord chamber 56 that is shown in FIG. 9.

Figure 9:
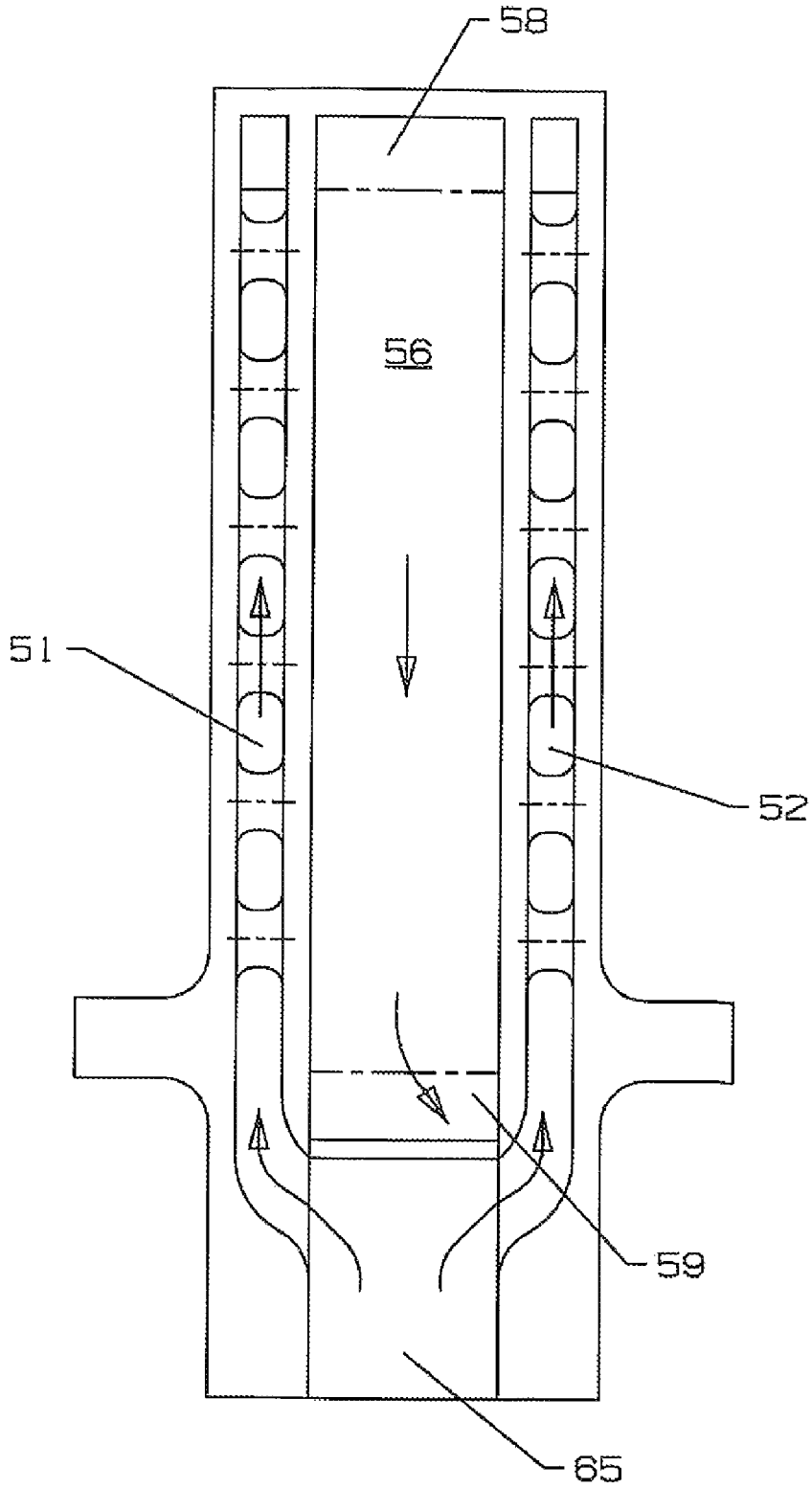
FIG. 9 shows a cut-away view of the blade cooling circuit through a line B-B in FIG. 7.

FIG. 9 shows a cross section view through the line B-B in FIG. 7 and includes the second mid-chord chamber 56 located in-between the two up-pass channels 51 and 52 formed within the pressure side wall and the suction side wall. The common cooling air supply cavity 65 is shown connected to the two up-pass channels 51 and 52. The tip turn channel 58 is shown that connects the second mid-chord chamber to the first mid-chord chamber 55 at the blade tip turn. The cooling air from the first mid-chord chamber 55 flows through the tip turn channel 58 and into the second mid-chord chamber 56 of FIG. 9, which then flows down and into the root turn channel 59 and into the trailing edge up-pass channel 57.

In operation, cooling air is fed into the near wall cooling flow circuits on the first pressure side and first suction side up-pass cooling channels 51 and 52 and flows upward and around the pin fins 66 that extend across these channels. The cooling air then turns across the blade tip section in the first tip turn channels 58 formed on both sides of the airfoil wall at the blade tip. The cooling air then flows down through the first pressure and suction side near wall down-pass cooling channels 53 and 54 and around the pin fins that extend across these two channels. The cooling air then flows into the first mid-chord chamber 55 that is formed in-between the two down pass channels 53 and 54.

The cooling air that flows through the first mid-chord chamber 55 is partially bled off through a row of metering and impingement holes 72 to provide impingement cooling for the backside of the leading edge surface of the airfoil. The spent impingement cooling air in the L/E impingement cavity 71 then flows out through the showerhead film cooling holes 73 to provide a layer of film cooling air for the leading edge, and if the gill holes 74 are used provide additional film cooling for the airfoil.

The cooling air from the first mid-chord chamber 55 that is not bled off through the row of metering and impingement holes 72 then flows around the tip turn channel 58 and into the second mid-chord chamber 56 that is formed between the two up-pass channels 51 and 52. The cooling air collected in the second mid-chord chamber 56 then flows though the root turn channel 59 and into the trailing edge up-pass channel 57 and then through the row of impingement holes and impingement cavities and then through the row of T/E exit holes or slots 64 and out from the airfoil. For the trailing edge cooling circuit, a series of straight holes or multiple impingement cooling holes can be used for the cooling of the airfoil T/E region.

The serpentine flow cooling circuit of the present invention includes two 5-pass serpentine circuits that are part separate and part interconnected. One 5-pass serpentine circuit includes a first leg or channel 51, a second leg 53, a third leg 55, a forth leg 56 and a fifth leg 57 and flows in that direction. The second 5-pass serpentine circuit includes a first leg or channel 52, a second leg 54, a third leg 55, a fourth leg 56 and a fifth leg 57. I these first and second 5-pass serpentine circuits, the third leg 54, the fourth leg 56 and the fifth leg 57 are common to both 5-pass serpentine circuits. Only the first and second legs are separate from each other.

This cooling air circuit of the present invention is totally different from the prior art method of cooling with the 5-pass serpentine flow cooling circuit. The prior art 5-pass serpentine flow cooling air is fed through the blade aft section and then flows forward in the forward flowing serpentine circuit or fed through nears the blade leading edge forward section and then flows aft toward the trailing edge for the aft flowing serpentine circuit design. The 5-pass serpentine cooling air in the serpentine flow cooling circuit of the present invention is fed through the blade mid-chord section. Since the cooling air temperature is fresh (not yet heated up) and the blade mid-chord section contains more metal than both the L/E and T/E ends of the airfoil, a maximum use of the cooling air potential is achieved with a low mass average temperature and yield a higher stress rupture life for the blade. In addition, the use of near wall cooling in the airfoil mid-chord section will maximize the benefit of using a thick TBC. Since the forward flowing circuit for the 5-pass serpentine includes only two cooling flow channels, the BFM issue described above in the prior art serpentine circuit will also be minimized.

In the serpentine flow circuit of the present invention, locating the two mid-chord chambers 55 and 56 between the near wall mid-chord cooling channels 51-54 will minimize the overheating of the cooling air as occurs in the cited prior art serpentine flow circuits. The use of the triple or 3-pass serpentine flow circuit in the airfoil mid-chord chamber will provide cooling for the airfoil tip cap and recirculation of warm cooling air for the near wall and into the backside of the near wall flow channel to heat up the inner wall for the near wall cooling channel and reduce the through wall thermal gradient and prolong the airfoil LCF (Low Cycle Fatigue) life.

Major design features and advantages of the serpentine flow cooling circuit of the present invention over the cited prior art serpentine circuits are described below. Minimize the blade BFM issue with two forward flowing serpentine channels instead of the 5-pass forward flowing serpentine cooling channels. The blade total cooling air is fed through the airfoil mid-chord section and flows toward the airfoil leading edge that maximizes the use of the cooling potential for the cooling air. The use of near wall cooling with total airfoil cooling flow for the airfoil mid-chord section will maximize the cooling potential with a thick TBC. Higher cooling mass flow through the airfoil main body yields a lower mass average blade metal temperature that translates into a higher stress rupture life for the blade. The 5-pass serpentine flow circuit of the present invention consumes less pressure than the forward flowing 5-pass serpentine circuit of the prior art which results in a lower cooling supply pressure requirement and thus lower leakage flow.

All the high heat transfer in the serpentine turns for the 5-pass serpentine circuit occurs along the blade pressure and suction peripherals which will enhance the blade tip section convection cooling. In addition, the tip turns for the mid-chord chamber triple pass serpentine circuit also provides additional tip section cooling. As a result of the cooling circuit design, better cooling for the blade tip is produced.

The combination of near wall and traditional serpentine cooling for a forward then aft flowing 5-pass cooling flow design maximizes the use of cooling air and provides a very high overall cooling efficiency for the entire airfoil.

The aft flowing serpentine cooling flow circuit used for the airfoil main body will maximize the use of cooling for the main stream gas side pressure potential. A portion of the air is discharged at the aft section of the airfoil where the gas side pressure is low and thus yields a high cooling air to mainstream potential to be used for the serpentine channels and maximize the internal cooling performance for the serpentine circuit.

The third and fourth serpentine cooling channels are located behind the first and second serpentine channels and thus will heat up the inner ribs for the first and second near wall serpentine flow passages and improve the airfoil LCF capability.

Shielding the third and fourth serpentine channels provide better cooling potential for the airfoil trailing edge cooling and lower cooling air pressure to the trailing edge which yields a better trailing edge cooling geometry.

I claim the following:

1. An air-cooled turbine blade comprising:

an airfoil with a leading edge with a leading edge impingement cavity and a showerhead arrangement of film cooling holes to discharge film cooling air from the leading edge impingement cavity;

a trailing edge with a trailing edge cooling circuit and a row of trailing edge exit cooling holes to discharge cooling air from the blade;

a first up-pass near wall cooling channel formed on a pressure side wall of the airfoil and located in an airfoil mid-chord region;

a first down-pass near wall cooling channel formed on the pressure side wall of the airfoil and located adjacent to and forward of the first up-pass near wall cooling channel;

a second up-pass near wall cooling channel formed on a suction side wall of the airfoil and located in the airfoil mid-chord region;

a second down-pass near wall cooling channel formed on the suction side wall of the airfoil and located adjacent to and forward of the second up-pass near wall cooling channel;

the first up-pass channel connected to the first down-pass channel through a first tip turn channel;

the second up-pass channel connected to the second down-pass channel through a second tip turn channel;

a first mid-chord chamber formed between the first down-pass channel and the second down-pass channel;

a second mid-chord chamber formed between the first up-pass channel and the second up-pass channel;

a trailing edge up-pass channel formed in the trailing edge region and extending across the pressure sidewall and the suction sidewall;

the second mid-chord chamber being connected to the first mid-chord chamber at a tip turn channel; and, the second mid-chord chamber being connected to the trailing edge up-pass channel through a root turn channel.

2. The air-cooled turbine blade of claim 1, and further comprising:

a first serpentine flow cooling circuit is formed on the pressure side wall of the airfoil and comprises the first up-pass near wall cooling channel and the first down-pass near wall cooling channel; and, a second serpentine flow cooling circuit is formed on the suction side wall of the airfoil and comprises the second up-pass near wall cooling channel and the second down-pass near wall cooling channel.

3. The air-cooled turbine blade of claim 2, and further comprising:

the first mid-chord chamber and the second mid-chord chamber and the trailing edge up-pass channel form a common serpentine flow path for the remaining serpentine flow paths for the first and the second serpentine flow cooling circuits.

4. The air-cooled turbine blade of claim 1, and further comprising:

the leading edge impingement cavity is connected to the first mid-chord chamber through a row of metering and impingement holes.

5. The air-cooled turbine blade of claim 1, and further comprising:

the trailing edge cooling circuit includes a row of impingement holes and a row of trailing edge exit holes connected to the trailing edge up-pass channel.

6. The air-cooled turbine blade of claim 1, and further comprising:

the up-pass near wall cooling channels and the down-pass near wall cooling channels each include pin fins extending across the channels to promote heat transfer from the channel walls to the cooling air flowing through the channels.

7. The air-cooled turbine blade of claim 1, and further comprising:

the up-pass near wall cooling channels and the down-pass near wall cooling channels are without film cooling holes.

8. The air-cooled turbine blade of claim 1, and further comprising:

the three up-pass channels and the two down-pass channels and the two mid-chord chambers all extend along the radial length of the airfoil of the blade.

9. A process for cooling a turbine blade using a low cooling flow, the process comprising the steps of:

passing a first cooling air flow through a 2-pass serpentine flow circuit along the pressure side wall of the blade in a forward flowing direction;

passing a second cooling air flow through a 2-pass serpentine flow circuit along the suction side wall of the blade in a forward flowing direction;

merging the first and second cooling air flow into a mid-chord chamber located adjacent to a leading edge region of the blade;

bleeding off a portion of the merged cooling air to produce impingement cooling of a backside of a leading edge surface of the blade and discharging the spent impingement cooling air as a layer of film cooling air onto the leading edge surface;

passing the remaining merged cooling air through a second mid-chord chamber;

passing the remaining merged cooling along a trailing edge region of the airfoil toward the blade tip;

gradually bleeding off the remaining merged cooling air through a trailing edge cooling circuit to cool the trailing edge region; and, discharging the remaining merged cooling air out through trailing edge exit holes.

10. The process for cooling a turbine blade of claim 9, and further comprising the step of:

passing the cooling air in the 2-pass serpentine flow circuits around pin fins to promote heat transfer from the channel walls to the cooling air.

11. The process for cooling a turbine blade of claim 9, and further comprising the step of:

cooling a section of the blade tip with the cooling air flow through tip turns in the 2-pass serpentine flow circuits.

12. The process for cooling a turbine blade of claim 9, and further comprising the step of:

cooling a section of the blade tip with the cooling air flow through tip turn between the two mid-chord chambers.

* * * * *